United States Patent [19]

Chu

[11] Patent Number: 4,525,078

[45] Date of Patent: Jun. 25, 1985

[54] ELECTROMAGNETICALLY-INDUCED ROCKING CLOCK

[76] Inventor: Kuo-Chin Chu, 10-4 Fl., No. 62 Chang Chun Rd., Taipei, Taiwan

[21] Appl. No.: 554,281

[22] Filed: Nov. 22, 1983

[51] Int. Cl.[3] ..... G04B 17/02

[52] U.S. Cl. ..... 368/134; 368/165; 368/179

[58] Field of Search ..... 368/179, 134

[56] References Cited

U.S. PATENT DOCUMENTS 4,395,137 7/1983 Wiley ..... 368/179

FOREIGN PATENT DOCUMENTS 56-49972 5/1981 Japan ..... 368/179

2017982 10/1979 United Kingdom ..... 368/179

*Primary Examiner*—Bernard Roskoski

[57] ABSTRACT

An electromagnetically-induced rocking clock includes an adjustable combination rod fixed with a permanent magnet, two abrasion-resistant sockets formed on the combination rod and two supporting needles fixed with a rocking clock body having an induction coil corresponding to the permanent magnet and pivotedly mounted on the two sockets whereby the permanent magnet can be adjusted by adjusting the vertical or horizontal plate of the combination rod to be applicable for different sizes of clocks and the clock body or pendulum can smoothly swing on two fulcra formed on the two sockets.

2 Claims, 6 Drawing Figures

ELECTROMAGNETICALLY-INDUCED ROCKING CLOCK

BACKGROUND OF THE INVENTION

Conventional quartz clock comprising a coil and a permanent magnet is operated by the magnetic repulsive force to cause the continuous oscillation of clock body or pendulum. In this way, a fixed clock body B with a pendulum pivotedly formed on the clock body as FIG. 1 shown, or a swinging casing A including clock body B and pendulum being pivotedly mounted on a pole C as FIG. 2 shown were disclosed. In FIGS. 2 and 3, the rhombic pole C is formed with two fulcra d1, d2 on its top portion to support the swinging casing A and clock body B at an inversed V-slot f formed inside a sleeve e of casing A. The gravity center of this rocking clock can be adjusted to exactly locate between two fulcra d1 and d2. However, such conventional rocking clocks as shown in FIGS. 1 and 2 still have the following defects:

1. To correspond the induction coil a on the swinging casing A, a magnet b is fixedly positioned so that it is suitable only for specific size of clock diameter.

2. Two fulcra d1, d2 are fixedly positioned on rhombic pole C and the inversed V-slot f is also formed in a fixed position inside the sleeve e so that their fabrication should require high precision technique to increase the production cost.

3. To use this type of clock, it is necessary to adjust the inversed V-slot f of sleeve 3 to fall between two fulcra d1, d2. This can be done only by a skilled person.

4. When encountering environmental vibration, the inversed V-slot will easily slide between two fulcra and the distance between permanent magnet and induction coil will be influenced to easily stop the swinging motion of clock.

5. The pendulum g hung on the clock is very light and is easily oscillated in an irregular way by air blowing or other reasons.

6. The contact area between the rhombic fulcra d1, d2 and extensions d3, d4 is so large, which may increase the abrasion therebetween and may even stop the swinging of pendulum.

The present inventor has found the defects of conventional clocks and invented the present electromagnetically-induced rocking clock.

SUMMARY OF THE INVENTION

The object of the present invention is to provide an electromagnetically-induced rocking clock which includes an adjustable combination rod, two abrasion-resistant sockets formed on the combination rod, and two supporting needles fixed on rocking clock body each being pivotedly mounted on each of the two sockets whereby the permanent magnet fixed on the combination rod can be adjusted corresponding to an induction coil fixed on clock body to be suitable for different sizes of clocks and the abrasion between the needles and the sockets is minimized to smoothly and stably enforce the swinging motion of the clock or pendulum.

DETAILED DESCRIPTION

Figure 1:
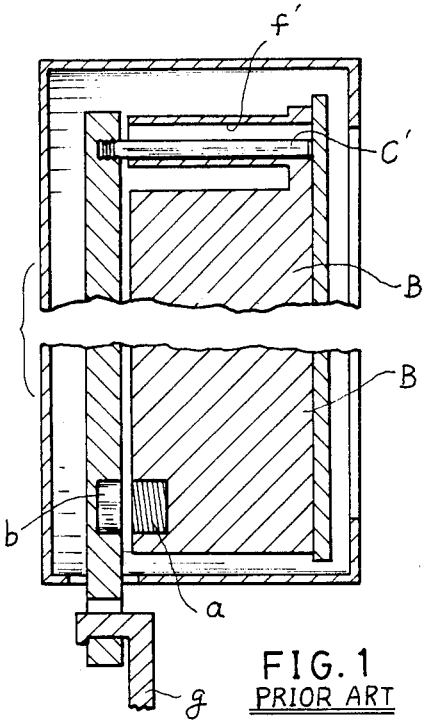
FIG. 1 PRIOR ART
FIG. 1 is a partial side view illustration of conventional rocking clock.
Figure 4:
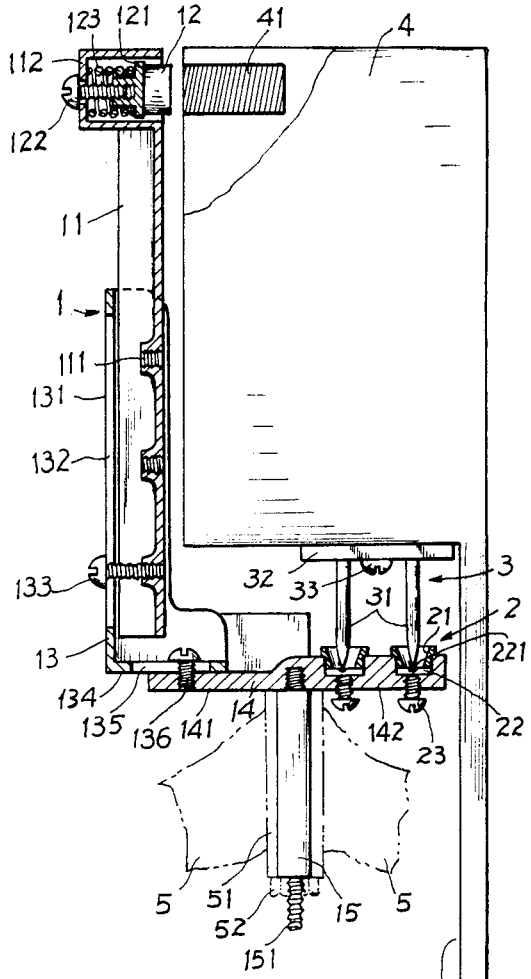
FIG. 4 is an illustration showing the rocking clock of the present invention.
Figure 2:
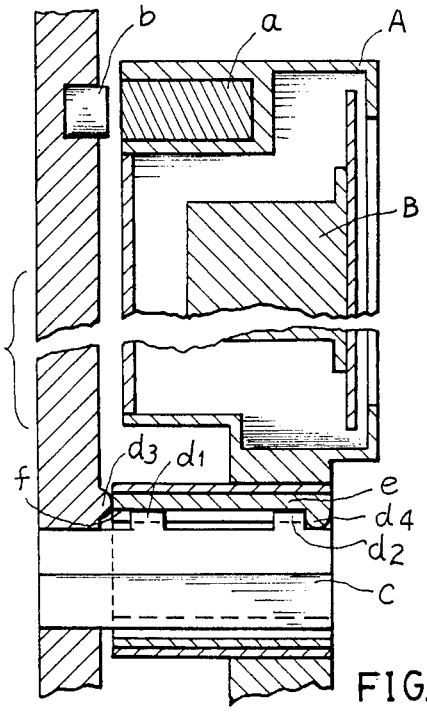
FIG. 2 PRIOR ART
FIG. 2 is a partial side view illustration of another conventional rocking clock.
Figure 3:
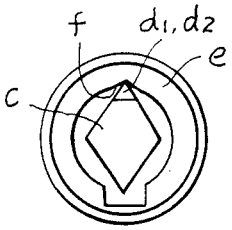
FIG. 3 is an illustration showing the rhombic pole and sleeve of FIG. 2.

As shown in FIG. 4, the present invention comprises an adjustable combination rod 1, two abrasion-resistant sockets 2 formed on the combination rod, and two supporting needles 3 fixed on the swinging clock body 4.

The vertical rod 11 of adjustable combination rod 1 is formed with several positioning screw holes 111. The top end of rod 11 is connected with a casing 112 wherein a pair of permanent magnets 12 is provided to correspond an induction coil 41 formed on the swinging clock body 4. Permanent magnet 12 is connected to a seat 121 which is adjustably fixed on casing 112 by a screw 122 and tensioned by a spring 123 within casing 112. On vertical plate 131 of a L-shaped connection rod 13, there provides a series of positioning holes 132 to allow the fixing screw 133 to pass through holes 132 and then to be fixed into positioning screw hole 111 on the vertical rod 11.

On horizontal plate 134 of L-shaped connection rod 13, there provides a series of positioning holes 135 to allow the fixing screw 136 to pass through holes 135 and then be fixed into positioning screw hole 141 on the horizontal rod 14. On the extension portion 142 of horizontal rod 14, there provides two abrasion-resistant sockets 2 each being formed with an inversed truncated cone hole 21 which is lowerly terminated with a bottom plate 22 made as abrasion-resistant steel or jewel-like sheet. A recess portion 221 is centrally formed on bottom plate 22 to support each of the two supporting needles 31 fixed on the swinging body 4. Beneath the bottom plate 22, there provides an adjusting screw 23 to adjust the horizon of two supporting needles 3. On horizontal rod 14, there provides a supporting rod 15 which is inserted into a sleeve 51 formed on a decorative figurine seat or hanging rack 15 and fixed by a bolt 151 and nut 52.

When using the present invention, supporting rod 15 is inserted into sleeve 51 and fixed by bolt 151 and nut 52. Two supporting needles 31 with pertinent base plate 32 is fixed on clock body 4 by a screw 33. Two needles 3 are respectively pivotedly mounted on the recess portions 221 of bottom plates 22 which are fixed into two abrasion-resistant sockets 2 of horizontal rod 14. By modifying the opening angle of the inversed truncated cone hole 21 of two abrasion-resistant sockets 2, the swinging angle of the clock body 4 can be strictly limited.Fixing screw 136 after passing through positioning hole 135 formed on horizontal plate 134 of L-shaped connection rod 13 is fixed into positioning screw hole 141 on horizontal rod 14. Fixing screw 133, after passing through the positioning hole 132 formed on vertical plate 131 of L-shaped connection rod 13, is fixed into positioning screw hole 111 on vertical rod 11.

The permanent magnet 12 on top casing 112 of vertical rod is so adjusted to correspond the induction coil 41 formed on clock body 4. Meanwhile, the distance between permanent magnet 12 and induction coil 41 can be adjusted by rotating screw 122 on casing 112.

Figure 5:
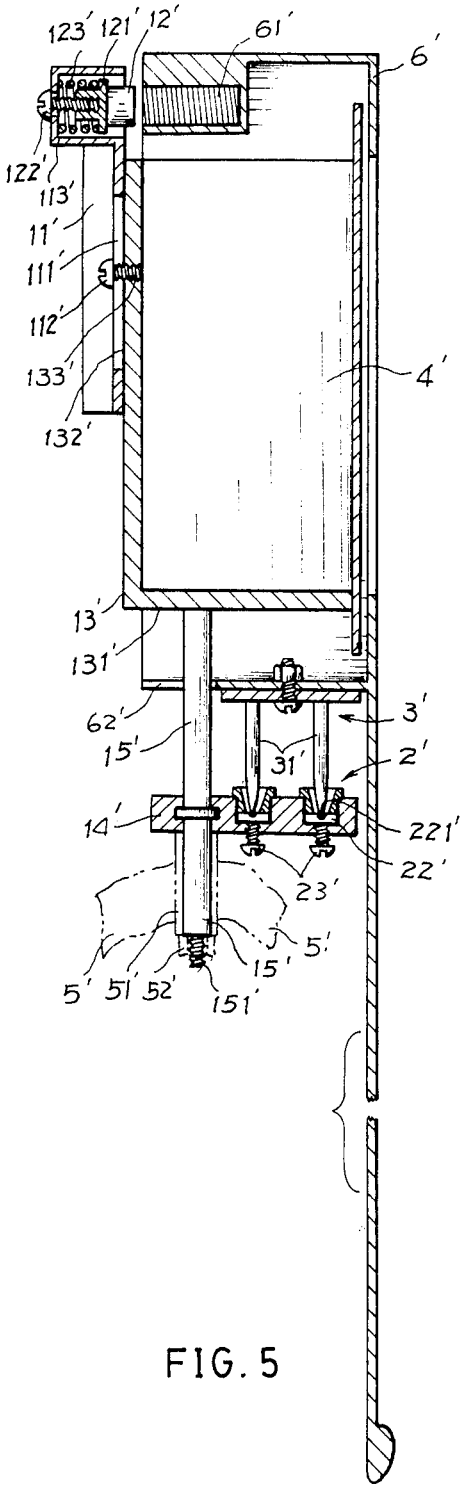
FIG. 5 is an illustration showing another preferred embodiment of the present invention.

Another preferred embodiment of the present invention is shown in FIG. 5, which comprises a quartz clock with electronic music attachment on a L-shaped supporting rack 13', of which the horizontal plate 131' is connected with a supporting rod 15' which is inserted into sleeve 51' of a figurine seat or hanging rack 15' and is fixed by a bolt 151' and a nut 52'. A horizontal rod 14' formed with two abrasion-resistent sockets 2' is fixed on supporting rod 15'. The vertical plate 132' of supporting rack 13' is formed with several positioning screw holes 133' which may be fixed by a fixing screw 112' passing through a positioning hole 111' on vertical rod 11'. A casing 113' is formed on the top end of vertical rod 11'. Permanent magnet 12' is provided within the casing 113' to correspond an induction coil 61' fixed in a swinging casing 6'. Each of two supporting needles 3' is respectively pivotedly mounted on a recess portion 221' of bottom plate 22' made as abrasion-resistant steel or jewel-like sheet in each abrasion-resistant socket 2'. The lower portion of casing 6' is formed with an opening 62' to allow free oscillation of casing 6' and pendulum without being obstructed by supporting rod 15'.

Figure 6:
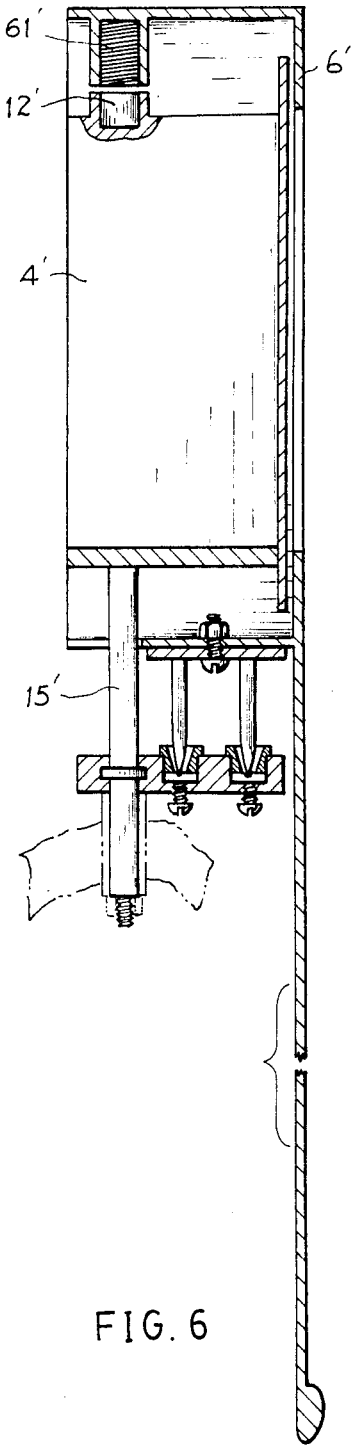
FIG. 6 is an illustration showing still another preferred embodiment of the present invention.

Referring the above-mentioned embodiment, clock casing 4' can be directly placed on supporting rod 15' by omitting L-shaped supporting rack 13' and vertical rod 11' as FIG. 6 shown. Permanent magnet 12' is fixed on the top portion of clock casing 4' to correspond an induction coil 61' fixed inside casing 6'.

The present invention has the following advantages:

1. Permanent magnet is adjustably positioned on vertical rod to be applicable for different sizes of clocks.
2. Clock body or pendulum is swung without being influenced by environmental vibration or air blowing.
3. The gravity center of swinging clock can be adjusted easily to fall between two supporting needles so that the fabrication precision is not so critical and production cost will thus be reduced.
4. Abrasion resistance is smaller and swinging force is larger than the conventional clock.
5. The installation is simpler merely by putting two supporting needles into two abrasion-resistant sockets.
6. No balancing problem occurs even increasing weight of electronic music clock or replacing different parts.

What is claimed is:

1. An electromagnetically-induced rocking clock having:

an adjustable combination rod including a vertical rod fixed with a permanent magnet thereon, a L-shaped connection rod having a vertical plate connected with said vertical rod and a horizontal plate connected with a horizontal rod, and a horizontal rod fixed on a decorative figurine seat or hanging rack;

two abrasion-resistant sockets formed on said horizontal rod of said combination rod;

two supporting needles fixed on a rocking clock body or swinging casing and pivotedly mounted on said two abrasion-resistant sockets respectively; and a rocking clock body or swinging casing fixed with an induction coil corresponding to said permanent magnet to swing along two fulcra on said abrasion-resistant sockets;

said adjustable combination rod having said vertical rod formed with several positioning screw holes thereon, said L-shaped connection rod having said vertical plate formed with a series of positioning holes thereon to permit a fixing screw to pass through said positioning hole on said vertical plate and to be fixed into said positioning screw hole on said vertical rod so that said permanent magnet can be adjusted vertically along said L-shaped connection rod and having a horizontal plate formed with a series of positioning holes thereon, said horizontal rod formed with a positioning screw hole thereon to permit a fixing screw to pass through said positioning hole on said horizontal plate and fixed into said positioning screw hole on said horizontal rod so that said permanent magnet can be adjusted horizontally along said horizontal rod; said two abrasion-resistant sockets each being formed with an inversed truncated cone hole which is lowerly terminated with a bottom plate adjustably fixed on said horizontal; and two supporting needles, connected to a base fixed under said rocking clock body, respectively pivotedly mounted on said two abrasion-resistant sockets, whereby the horizon of said clock body can be adjusted by adjusting said bottom plates of said abrasion-resistant sockets.

2. A rocking clock according to claim 1, wherein said bottom plate of said abrasion-resistant socket is centrally formed with a recess portion to pivotedly support said supporting needle, and is adjusted by a screw fixed through said horizontal rod.

* * * * *